US006481610B1

(12) United States Patent
Liu et al.

(10) Patent No.: US 6,481,610 B1
(45) Date of Patent: Nov. 19, 2002

(54) NAIL GUN WITH WASHER FEEDING DEVICE

(76) Inventors: Hsien Nung Liu, 12Fl., No. 100 Ming-Chuan Rd., Hsin-Tien, Taipei-Hsien (TW); Chien Chi Chou, 12Fl., No. 100 Ming-Chaun Rd., Hsin-Tien, Taipei-Hsien (TW)

( * ) Notice: Subject to any disclaimer, the term of this patent is extended or adjusted under 35 U.S.C. 154(b) by 159 days.

(21) Appl. No.: 09/628,240

(22) Filed: Jul. 28, 2000

(30) Foreign Application Priority Data

Feb. 25, 2000 (TW) ..... 89203004 U

(51) Int. Cl.[7] ..... B25C 1/04

(52) U.S. Cl. ..... 227/18; 227/15; 227/119; 227/136; 227/138

(58) Field of Search ..... 227/119, 15, 18, 227/120, 130, 136, 138; 221/197

(56) References Cited

U.S. PATENT DOCUMENTS 3,595,460 A * 7/1971 Pitken ..... 227/130
5,056,684 A * 10/1991 Beach et al. ..... 221/197
5,163,580 A * 11/1992 Beach et al. ..... 221/197
5,634,583 A * 6/1997 McGuinness et al. ..... 227/119
5,673,816 A * 10/1997 Larson et al. ..... 221/273
5,791,546 A * 8/1998 McGuinness et al. ..... 227/119
6,273,315 B1 * 8/2000 McGuinness et al. ..... 227/18
6,302,310 B1 * 10/2001 Lamb ..... 227/119

* cited by examiner

*Primary Examiner*—Scott A. Smith

(57) ABSTRACT

A nail comprises a washer delivery device attached to the nail outlet of the nail gun having an internal elongate delivery groove for delivering washer to the nail outlet, a washer receiving device provided on top of washer delivery device in communication therewith such that washer may drop into the washer delivery device by either its own weight or pushed down by an elastic member received between washers and the top of washer receiving device, and a compressed air activated feeding device for pushing a dropped washer in the delivery groove to the nail outlet such that a case nail may penetrate washer. This can enhance the fixing of objects when secured by nail and washer combination.

12 Claims, 6 Drawing Sheets

NAIL GUN WITH WASHER FEEDING DEVICE

FIELD OF THE INVENTION

The present invention relates to an air operated nail gun and more particularly to a nail gun with washer feeding device.

BACKGROUND OF THE INVENTION

How to cause a tool to quickly effectively perform a specified job has long been a goal of modern society. We will take the job of casting nails as the subject in the following description.

Nails are seen everywhere in our environment. Conventionally, a worker uses a hammer to hit the head of nail for fixing one object to another. But such manual working is unacceptable slow in some fields. As such, there is the provision of compressed air operated nail gun for fulfilling such needs. It has the advantage of automatically continuously casting nail one by one for fixing one object to another. It is also understood that head of nail has the functions of guiding the casting direction when operated by compressed air and fixing the objects for preventing a sliding movement from occurring therebetween. As such, in some circumstances a washer is provided between the head of nail and the object for enhancing the fixing of nail and the object. However, such washer mounting is done manually. Heretofore, there is no disclosed document about a nail gun with washer feeding device.

SUMMARY OF THE INVENTION

It is therefore an object of the present invention to provide a nail gun with washer feeding device for enhancing the fixing capability of nail and washer combination.

The advantages of the present invention are realized by providing an improved nail gun comprising a flat case like washer delivery means attached to the nail outlet of the nail gun having an internal elongate delivery groove for delivering washer to the nail outlet; a washer receiving means including a receiving cylinder perpendicular to the top of washer delivery means with bottom attached to delivery groove such that washer may drop into the washer delivery means by either its own weight or pushed down by an elastic member received between washers and the top of washer receiving means; and a feeding device including a sliding block slidable in the delivery groove and an air cylinder for providing a driving force to the sliding block; wherein sliding block delivers the dropped washer in the delivery groove to the nail outlet such that a cast nail may penetrate washer together to fix one object to the other.

The above and other objects, features and advantages of the present invention will become apparent from the following detailed description taken with the accompanying drawings.

DETAILED DESCRIPTION OF PREFERRED EMBODIMENTS

Figure 1:
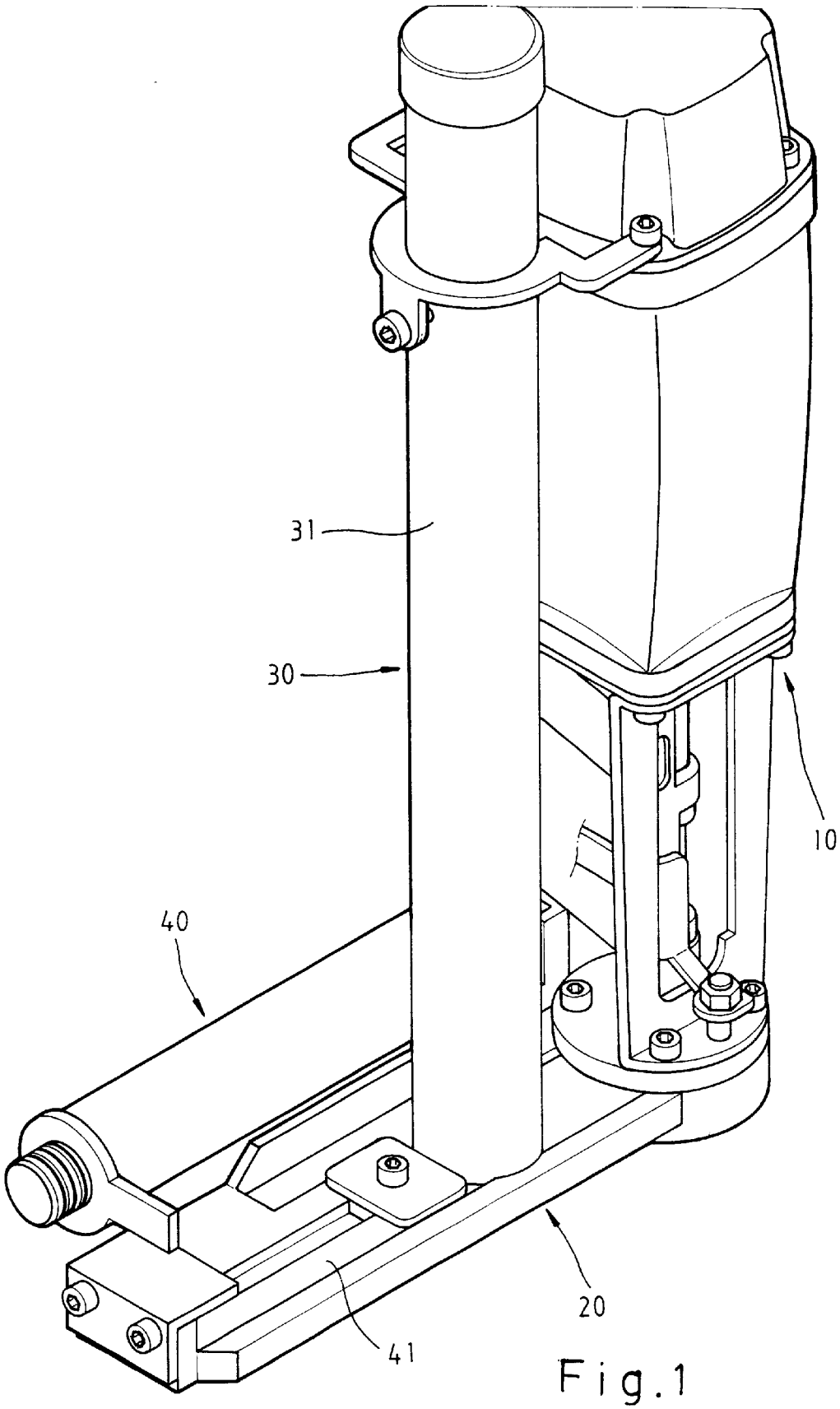
FIG. 1 is a perspective view of a preferred embodiment of nail gun with washer feeding device according to the invention.
Figure 2:
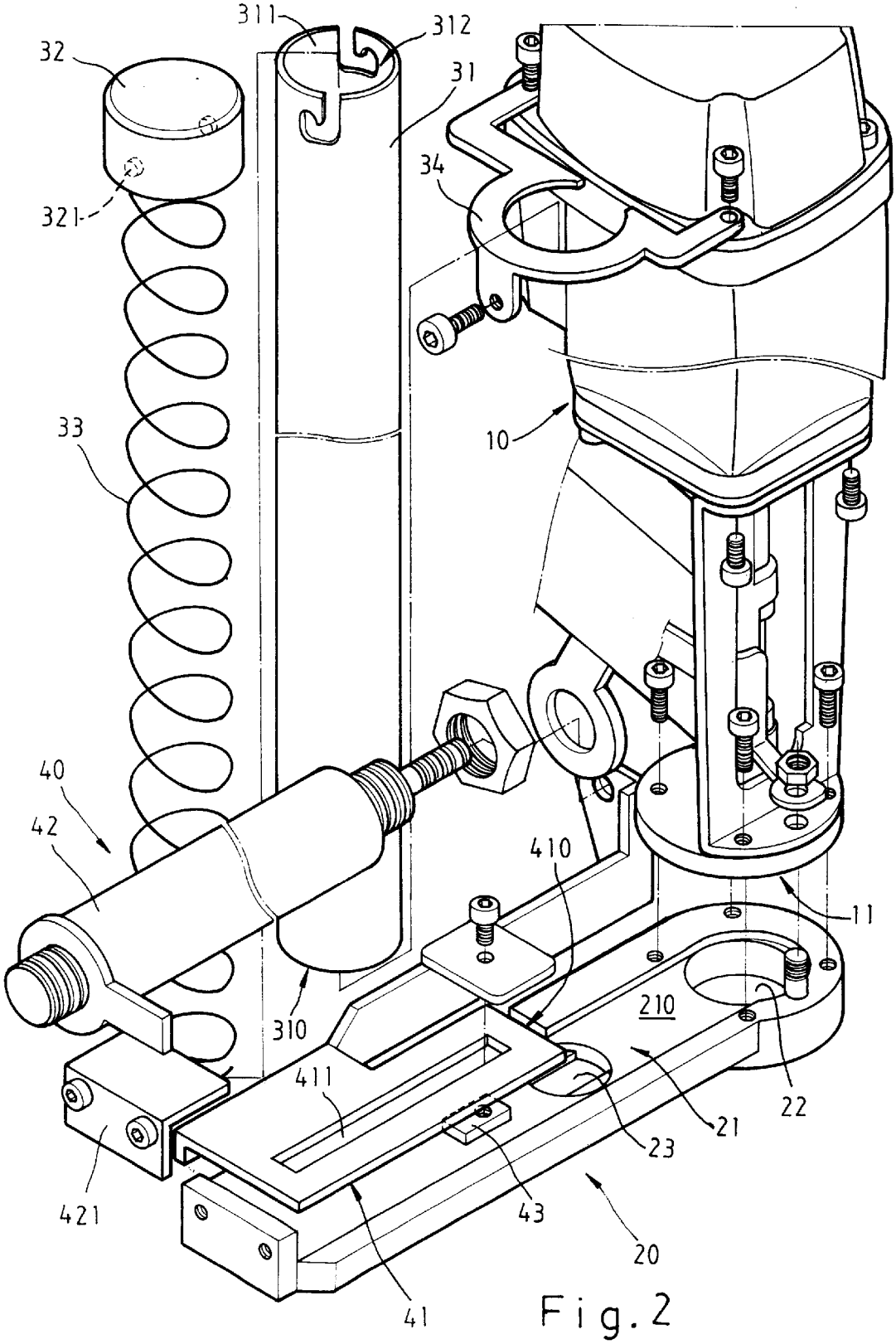
FIG. 2 is an exploded view of FIG. 1.

Referring to the accompanying figures particularly to FIGS. 1 and 2, there is shown an improved nail gun with washer feeding device constructed in accordance with the present invention. The washer feeding device is attached to a side of nail gun 10. Major components of the invention such are washer delivery means 20, washer receiving means 30, and feeding device 40 are detailed below.

A flat case like washer delivery means 20 with one end attached to the nail outlet 11 has an internal elongate delivery groove 21 for delivering washer 50 to the nail outlet 11. Delivery groove 21 is perpendicular to nail gun 10 having a width slightly larger than the diameter of washer 50 for permitting washer 50 to slide therein. An end outlet 22 is threadedly secured to the bottom of nail outlet 11 of nail gun 10. A washer receiving means 30 is provided at the top of washer delivery means 20 including a receiving cylinder 31, a top cap 32, and an elastic member 33 (e.g., spring). Receiving cylinder 31 is a hollow cylindrical member having two ends open for receiving a plurality of one by one stacked washers 50. Receiving cylinder 31 and nail gun 10 are secured together by a bracket 34. Receiving cylinder 31 is secured and perpendicular to delivery groove 21. The bottom outlet 310 of receiving cylinder 31 is on the top of delivery groove 21 being spaced from the washer passage 210 by a minimum distance for allowing washer 50 to pass through.

In a preferred embodiment of washer receiving means 30, two opposed L-shaped recesses 312 are provided on the surface abutted to the top opening 311. Cylindrical cap 32 has two corresponding opposed projections 321 at the inner surface so as to snap to the tips of recesses 312. Such engagement mechanism enables a quick mounting or disassembly of cap 32. It is appreciated that cap 32 and receiving cylinder 31 may be secured together by bolt and nut combinations or any of other conventional attachment means.

Figure 8:
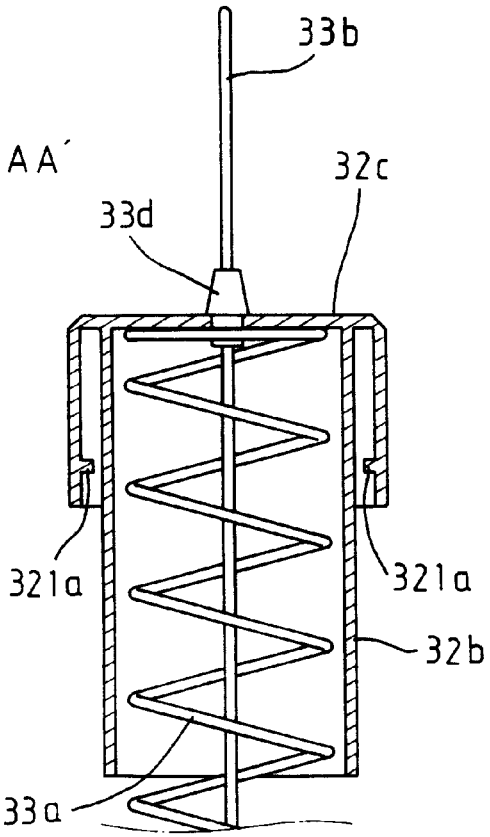
FIG. 8 is sectional view taken along line A-A of FIG. 7 to show the upper portion of cap in detail.
Figure 7:
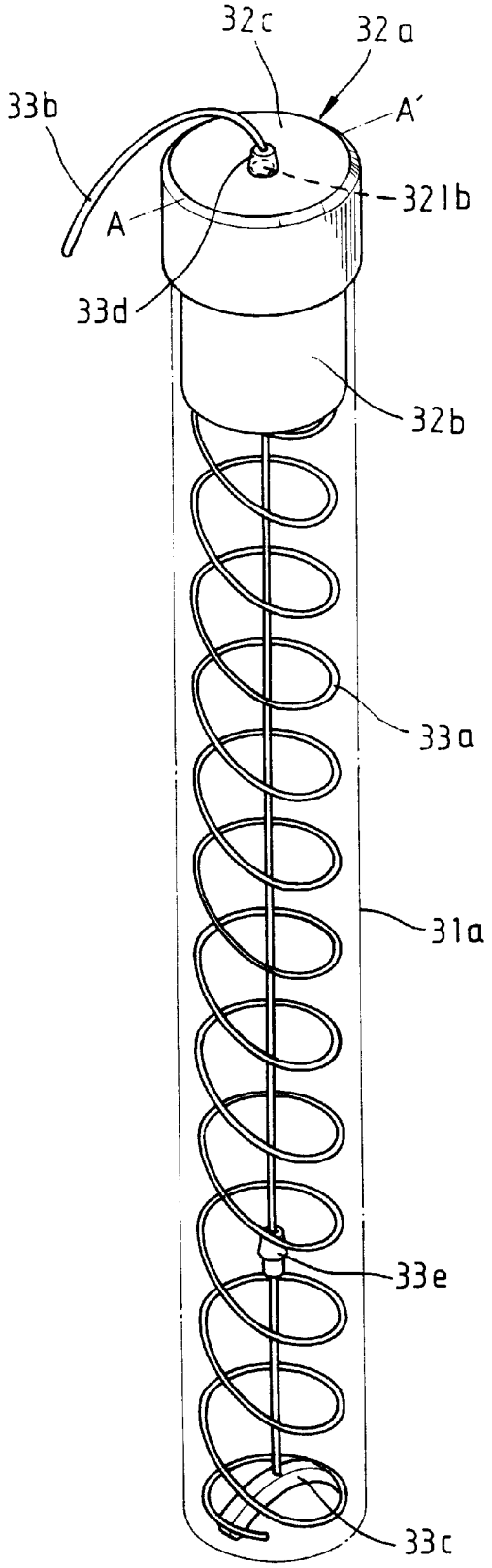
FIG. 7 is view of another embodiment of receiving cylinder schematically showing the construction of cap and its attachment to elastic member.
Figure 9:
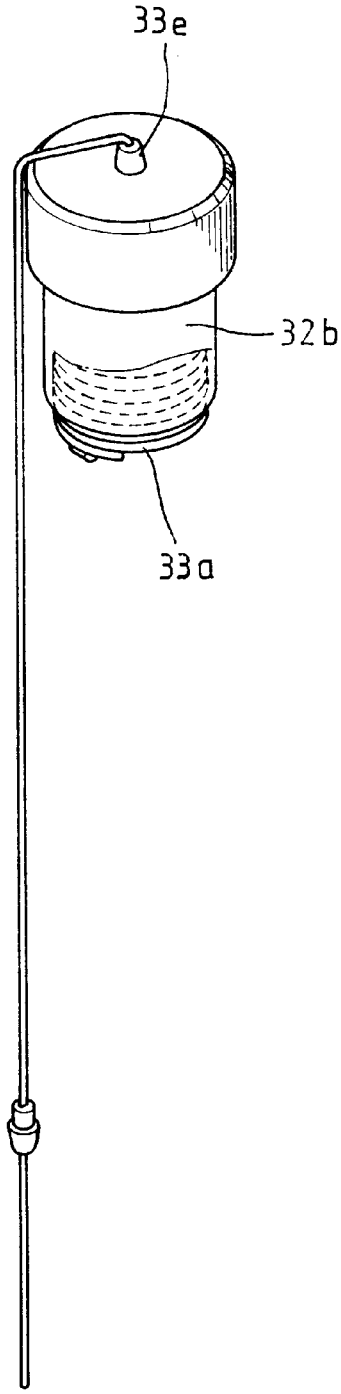
FIG. 9 is an operational view of FIG. 7 where elastic member has not dropped to engage with washer.

Referring to FIGS. 7, 8, and 9 specifically, there is shown another preferred embodiment of washer receiving means 30 wherein cap 32*a* includes a larger upper cylindrical member 32*c* with bottom open and a smaller lower cylindrical member 32*b* with two ends open. Similarly, upper cylindrical member 32*c* has two corresponding opposed projections 321*a* at the inner surface (FIG. 8) so as to snap to the tips of L-shaped recesses (not shown) of receiving cylinder 31*a*. A rope 33*b* passes through top center hole 321*b* of upper cylindrical member 32*c*. Upper portion of lower cylindrical member 32*b* is sleeved in the upper cylindrical member 32*c* (FIG. 8) for receiving elastic member 33*a*. As shown in FIG. 7, an arcuate stopping member 33*c* is provided at one end of rope 33*b* engaged with the end of elastic member 33*a*. The other end of rope 33*b* passes through cap 32*a* wherein two elastic enlargements 33*d* and 33*e* are provided. The distance between enlargements 33*d* and 33*e* is defined as maximum expansion length of elastic member 33*a*. Such design aims at facilitating a longer elastic member 33*a* to receive in receiving cylinder 31*a* in order to bias washers 50. As shown in FIG. 9, first pull rope 33*b* to lift and compress elastic member 33*a*. Then secure enlargement 33*e* on the hole 321*b* such that elastic member 33*a* may completely receive in cap 32*a*. Snap or threadedly secure cap 32*a* and receiving cylinder 31*a* together. Finally, press down enlargement 33*e* to cause it to clear from hole 321*b*. As such, elastic member 33*a* and rope 33*b* together move down in receiving cylinder 31*a* until elastic member 33*a* contacts with washer 50.

Figure 3:
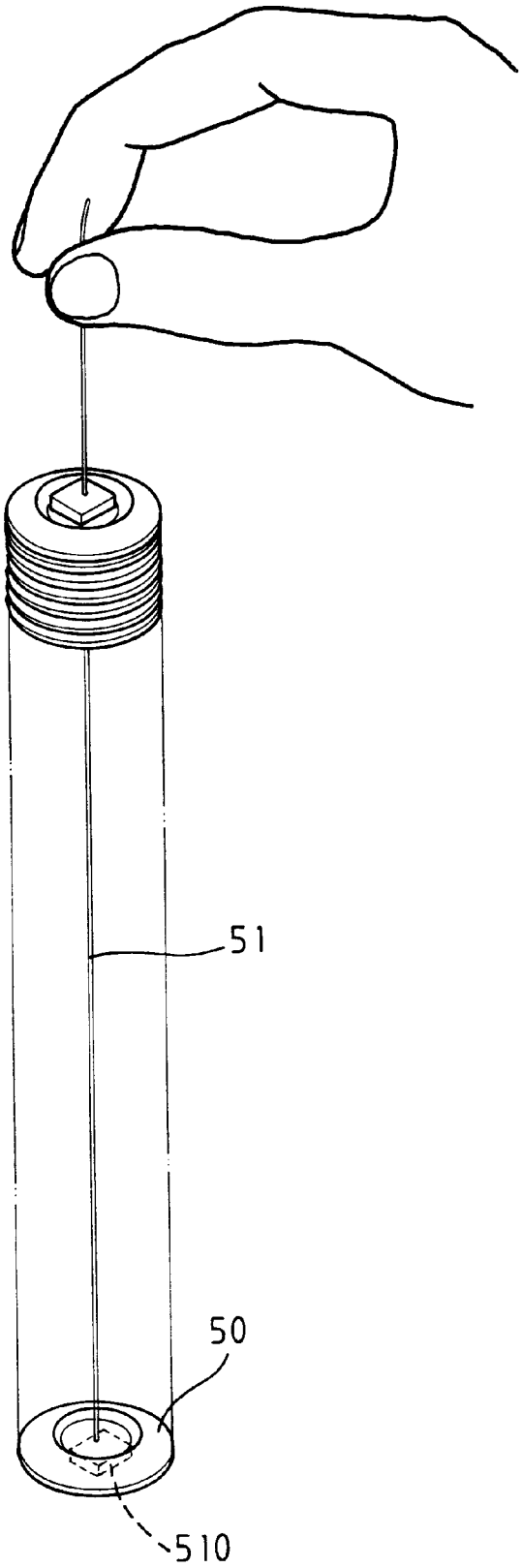
FIG. 3 is a perspective view to illustrate how to use a string to attach washers together.

Referring to FIG. 3 specifically, it is seen that receiving cylinder 31 is much longer than washer 50. As such, it is quite time consuming to place washer 50 in receiving cylinder 31 one by one. Further, the washers 50 may not evenly stack. Another technique is to slightly glue washers 50 together. But it is still disadvantageous because one washer 50 may too strongly glue with an upper adjacent one to be separated from each other when pushed. The novel design of the invention can eliminate above drawback. In detail, two limiting members 510 are temporarily provided at both ends of string 51. As such, user may string a plurality of washers 50 between two end limiting members 510 by means of string 51. With this, the plurality of washers 50 may evenly place in receiving cylinder 31 as a whole. Then remove string 51 from top opening 311 of receiving cylinder 31. The bottom limiting member 510 may be removed from outlet 23 beneath the bottom of receiving cylinder 31 because outlet 23 is hole through delivery groove 21 having a diameter larger than limiting member 510, while smaller than washer 50. As such, limiting member 510 may drop out of outlet 23, while washer 50 is prevented from dropping out of the outlet 23.

Figure 4:
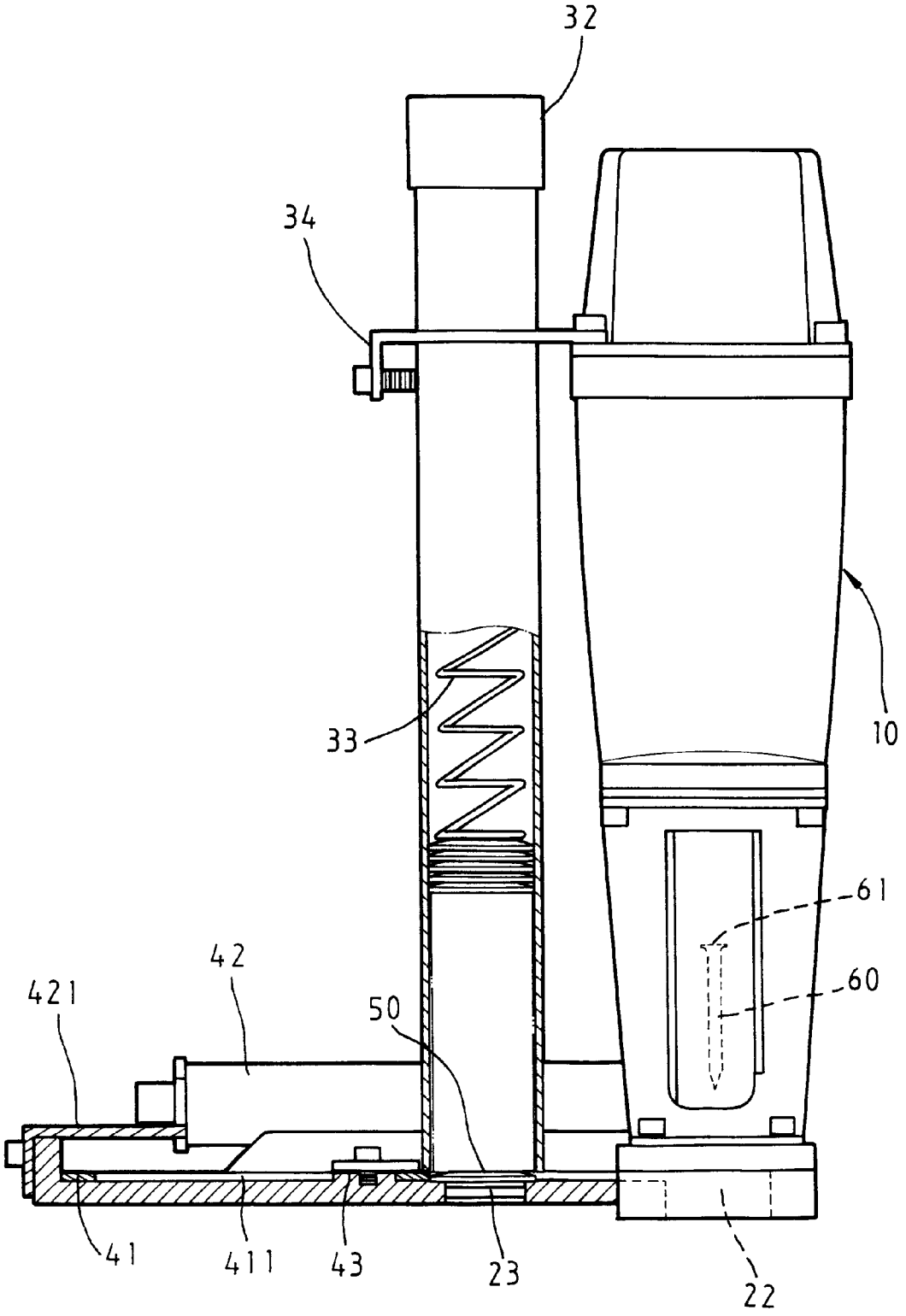
FIG. 4 is a side schematic partially broken away view where washer in the receiving cylinder dropped on the delivery groove.

Referring to FIG. 4 specifically, a first washer 50 is dropped on washer passage 210 of delivery groove 21, while other washers 50 are biased by elastic member 33 in receiving cylinder 31. As such, the next washer 50 may drop into the delivery groove 21 by its own weight or pushed down by elastic member 33 for preparing after the first washer 50 is pushed to the outlet 22.

Referring to FIGS. 1, 2, 4, and 5 specifically, feeding device 40 includes a sliding block 41 slidable in the delivery groove 21 and an air cylinder 42 for driving sliding block 41. One end of air cylinder 42 is secured to nail gun 10, while the other end is attached to bracket 421 secured to washer delivery means 20. Sliding block 41 is activated by air cylinder 42 to slidingly move.

Sliding block 41 is a flat plate having a thickness less than that of delivery groove 21 so as to freely slide in delivery groove 21. Washer 50 is pushed from a ready position (FIG. 4) to outlet 22 (FIG. 5) below the bottom of nail outlet 11 by front end 410 of activated sliding block 41. In the ready position as shown in FIG. 4, front end 410 is abutted on the left side of washer 50. Then front end 410 pushes washer 50 toward outlet 22 when air cylinder 42 is activated to cause sliding block 41 to slide toward nail outlet 11. The next washer 50*a* is stopped at bottom outlet 310 of receiving cylinder 31 by the displaced sliding block 41 after the first washer 50 has been moved. After sliding block 41 is pulled back to its original ready position by air cylinder 42 as shown in FIG. 4, the next washer 50*a* will move to the ready position in delivery groove 21 either by its own weight or pushed down by elastic member 33.

It is preferred to provide a limiting block 43 on the washer passage 210 of delivery groove 21. Correspondingly, an elongate opening 411 is provided on sliding block 41. As, such, limiting block 43 may slide to-and-fro in the opening 411. With the cooperation of limiting block 43 and opening 411, sliding block 41 may precisely position in the ready or pushed position.

Figure 6:
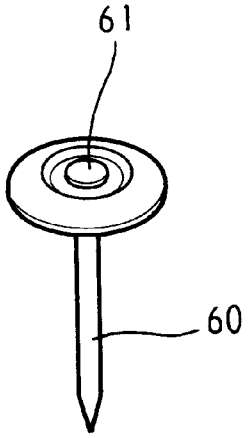
FIG. 6 is a perspective view showing the engagement of cast nail and washer.
Figure 5:
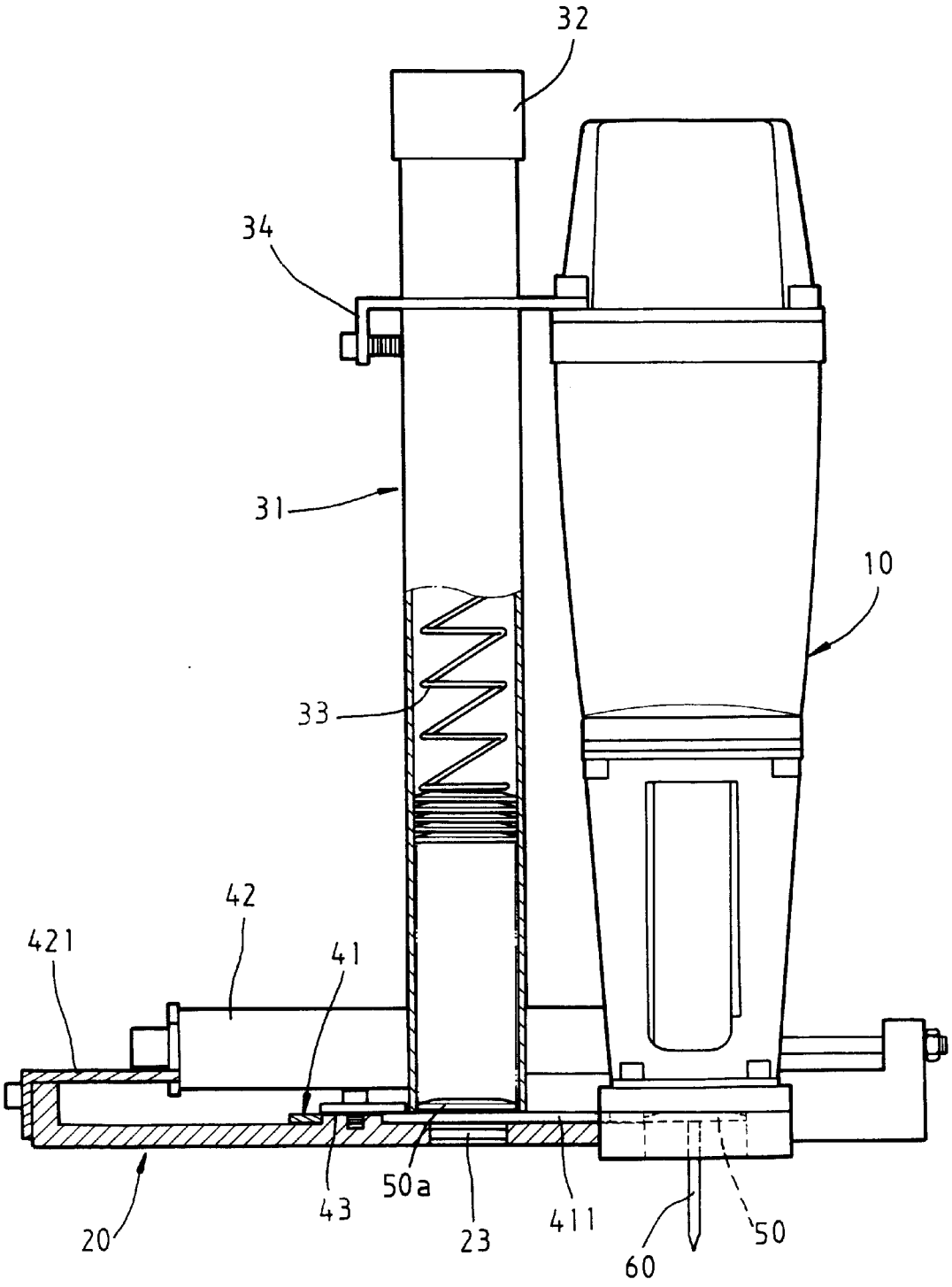
FIG. 5 is similar to FIG. 4 where washer pushed to nail outlet by sliding block and penetrated by nail.

Referring to FIGS. 5 and 6 specifically, a nail 60 is cast toward nail outlet 11 by nail gun 10 when washer 50 is pushed to the bottom of nail outlet 11. As such, tip of nail 60 passes the center hole of washer 50 to cause washer 50 to engage with head 61 of nail 60 (FIG. 6). Thereafter, the cast nail 60 and washer 50 together fix one object to the other. This invention can enhance the fixing capability of nail and washer combination.

While the invention has been described by means of specific embodiments, numerous modifications and variations could be made thereto by those skilled in the art without departing from the scope of the invention set forth in the claims.

What is claimed is:

1. A nail gun having a receiving space for storing a plurality of nails and a nail outlet comprising:

a flat case like washer delivery means attached to the nail outlet of the nail gun having an internal elongate delivery groove with a washer passage;

a washer receiving means including a hollow receiving member for storing a plurality of stacked washers having two opposed recesses, the receiving member being perpendicular to a top of the washer delivery means with a bottom attached to and in communication with the delivery groove such that the washer may drop into the washer delivery means by its own weight; and a feeding means including a sliding block slidable in the delivery groove and an air cylinder for activating the sliding block; wherein one end of the air cylinder is secured to the nail gun, while the other end is secured to the sliding block for causing the sliding block to move when the air cylinder is activated;

wherein the sliding block is positioned in a ready position when not moved with the front end abutted on the side of the washer and the sliding block is positioned in a pushed position when the washer is pushed below the nail outlet while stopping the next washer at the bottom end of the receiving member; and wherein the activated sliding block pushes a dropped washer in the delivery groove to the nail outlet such that a cast nail may penetrate the washer to engage together prior to leave the nail outlet.

2. The nail gun of claim 1, wherein the delivery groove has a width conformed to the diameter of the washer for permitting the washer to slide therein.

3. The nail gun of claim 1, wherein the washer receiving means further comprises a cap covered on a top end of the receiving member and an elastic member received in the receiving member.

4. The nail gun of claim 3 wherein the cap comprises two opposed projections at an inner surface secured to the recesses of the receiving member.

5. The nail gun of claim 3, wherein the cap further includes a rope, a larger upper cylindrical member with a bottom end open having a top center hole with the rope passed through, a smaller lower cylindrical member with two ends open having a portion sleeved in the upper cylindrical member for receiving the elastic member, a stopping member provided at one end of the rope engaged with the end of the elastic member, and two spaced elastic enlargements provided, on the rope such that the distance between the enlargements is defined as a maximum expansion length of the elastic member.

6. The nail gun of claim 5, wherein each of the enlargements has a shape of T.

7. The nail gun of claim 5, wherein the cap further comprises two opposed projections at the inner surface.

8. The nail gun of claim 1, further comprising a bracket for securing the nail gun and the receiving member together.

9. The nail gun of claim 1, wherein the receiving member has a cylindrical shape.

10. The nail gun of claim 1, wherein the washer passage is spaced from the bottom end of the receiving member by a predetermined distance for allowing the washer to pass through.

11. The nail gun of claim 1, wherein the recess of the receiving member is provided on the circumferential surface abutted to the top end of the receiving member having a shape of L.

12. The nail gun of claim 1, wherein the sliding block is a flat plate having a thickness less than that of the delivery groove.

* * * * *